US006137446A

United States Patent [19]

Jones

[11] Patent Number: 6,137,446

[45] Date of Patent: Oct. 24, 2000

[54] METHOD AND APPARATUS FOR MODULATING VOLTAGE TO AN ANTENNA REFLECTOR HEATER

[75] Inventor: Thaddeus M. Jones, Bremen, Ind.

[73] Assignee: MSX, Inc., South Bend, Ind.

[21] Appl. No.: 09/252,055

[22] Filed: Feb. 17, 1999

[51] Int. Cl.[7] ..... H01Q 1/02

[52] U.S. Cl. ..... 343/704; 343/840

[58] Field of Search ..... 343/704, 840, 343/912; 392/407, 422, 426; H01Q 1/02

[56] References Cited

U.S. PATENT DOCUMENTS 5,617,107 4/1997 Fleming ..... 343/704
5,920,289 7/1999 Jones ..... 343/704
6,064,344 5/2000 Walton ..... 343/704

*Primary Examiner*—Michael C. Wimer
*Attorney, Agent, or Firm*—Taylor & Aust, P.C.

[57] ABSTRACT

The invention is directed to a method of using a line voltage to heat an antenna reflector. The method includes the steps of providing an electrical heater for the antenna reflector, measuring a magnitude of the line voltage, ascertaining an ambient temperature, establishing a duty cycle for the heater dependent upon each of the measuring step and the ascertaining step, and cyclically connecting the line voltage to the heater and disconnecting the line voltage from the heater in accordance with the duty cycle. The duty cycle is defined as a percentage of total heating time in which the line voltage is electrically connected to the heater. The total heating time is a total time in which the ambient temperature is below a threshold temperature.

20 Claims, 4 Drawing Sheets

METHOD AND APPARATUS FOR MODULATING VOLTAGE TO AN ANTENNA REFLECTOR HEATER

BACKGROUND OF THE INVENTION

1. Field of the Invention

The present invention relates to antenna reflectors, and, more particularly, heated antenna reflectors.

2. Description of the Related Art

A reflector, commonly called a dish, is generally a parabolic section having a round or elliptical configuration. A reflector functions to gather radio or microwave frequency energy transmitted from the feedhorn or through the ambient environment from an external transmitter. The reflector can thus be used to receive and transmit signals to and from the satellite system. Reflectors are usually located outdoors, where snow and ice may collect on the receiving or concave side, degrading the performance of the reflector.

It is known to heat the front surface of a reflector with an electrical heating device in order to keep it clear of ice and snow. The heating device can be in the form of electrodes or resistance wire that is attached to the front surface of the reflector, embedded in the front surface, or attached to the back surface of the reflector. Further, it is known to energize the heating device with power line voltage, with 120 and 240 volts being common in the United States.

A problem is that these heaters are somewhat inefficient in terms of electrical power usage. In order to ensure that enough heating power is provided to melt the ice at the coldest operating temperatures, the heaters are configured to provide a level of power that is far in excess of what is required at the upper end of the range of operating temperatures. Besides wasting electricity, this excess dissipation of power can raise the temperature of the heating device and/or the reflector to a level where physical damage is done and the useful lives of the heating device and/or the reflector are reduced.

Another problem is that power line voltage varies widely through out the world. A different heater configuration is required with each different power line voltage in order to provide the reflector surface with a precise, desired level of electrical heating power.

What is needed in the art is an improved reflector heater assembly which can provide an appropriate level of electrical heating power at any ambient temperature and with any power line voltage.

SUMMARY OF THE INVENTION

The present invention provides a reflector heater assembly which modulates the line voltage applied to the heater such that an appropriate level of electrical heating power is provided to the heater, regardless of the ambient temperature and the magnitude of the line voltage.

The invention comprises, in one form thereof, a method of using a line voltage to heat an antenna reflector. The method includes the steps of providing an electrical heater for the antenna reflector, measuring a magnitude of the line voltage, ascertaining an ambient temperature, establishing a duty cycle for the heater dependent upon each of the measuring step and the ascertaining step, and cyclically connecting the line voltage to the heater and disconnecting the line voltage from the heater in accordance with the duty cycle. The duty cycle is defined as a percentage of total heating time in which the line voltage is electrically connected to the heater. The total heating time is a total time in which the ambient temperature is below a threshold temperature.

An advantage of the present invention is that a precise, desired level of electrical heating power can be dissipated by the reflector heater using any worldwide line voltage.

Another advantage is that the level of power dissipated by the heater is adjusted based upon the ambient temperature, thereby avoiding using more electrical power than is necessary to melt the ice on the reflector surface.

Yet another advantage is that the temperatures of the reflector surface and its heating device are not raised more than necessary to melt the ice, thereby extending the useful lives of the reflector and its heating device.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
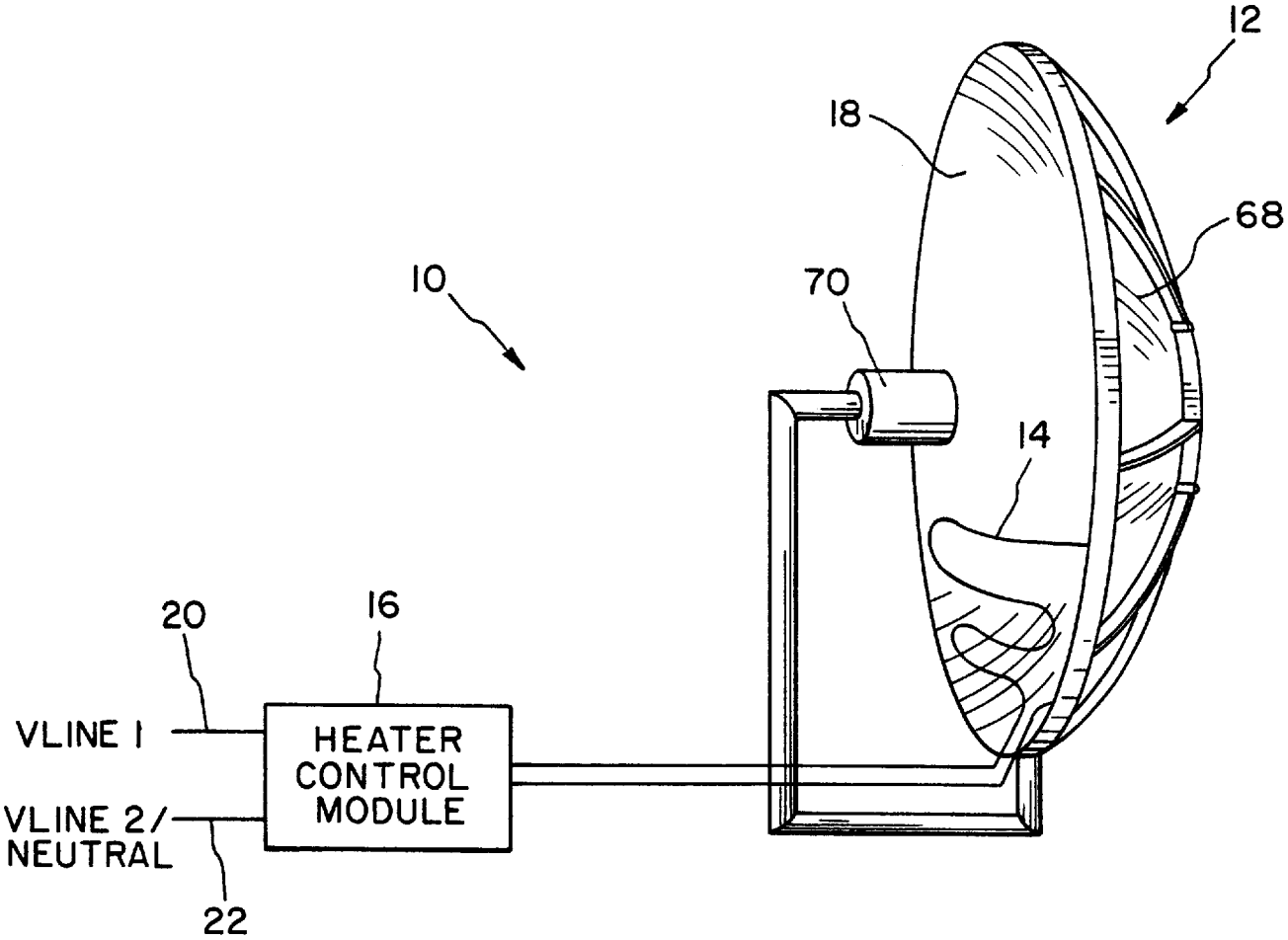
FIG. 1 is a perspective view of one embodiment of an antenna reflector assembly of the present invention.

Referring now to the drawings and particularly to FIG. 1, there is shown an antenna reflector assembly 10 including a reflector 12, a reflector heating device 14 and a heater control module 16. Reflector 12 includes a reflecting surface 18 which must be kept clear of ice and snow for optimum performance. Reflector heating device 14 is in the form of a resistance heating wire that is attached to reflecting surface 18 in order to melt any frozen precipitation thereon.

Figure 2:
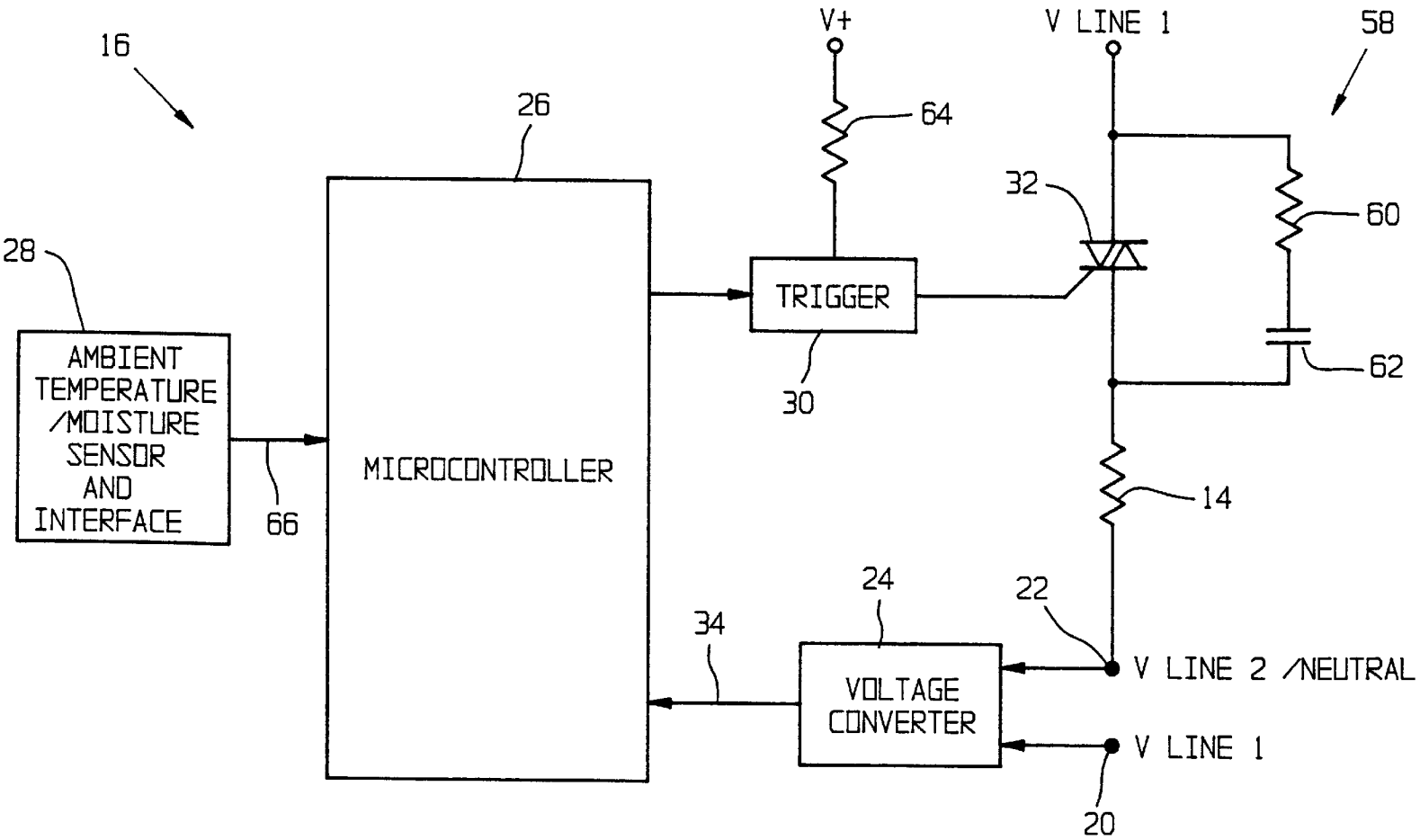
FIG. 2 is a schematic block diagram of one embodiment the heater control module of the antenna reflector assembly of FIG. 1.

Heater control module 16, shown schematically in FIG. 2, includes input terminals 20 and 22, voltage converter 24, electrical processor or microcontroller 26, ambient temperature/moisture sensor and interface 28, trigger device 30 and switching device 32. Input terminals 20 and 22 are connected to a source of electrical power, such as a power line voltage. Input terminal 20 is connected to VLINE1, and input terminal 22 is connected to VLINE2/NEUTRAL.

Heater control module 16 enables heating device 14 to efficiently heat a given size reflector 12 with any of the worldwide power line voltages, which range approximately between 100 and 240 volts AC, with a frequency of 50 or 60 Hz. With the exception of 240 volt domestic operation, all power lines voltage sources have a grounded neutral. Thus, VLINE1 is always live. VLINE2/NEUTRAL is only live when operating from a domestic 240 volt service.

Voltage converter 24 transmits an analog voltage signal on line 34 that is indicative of the magnitude of the input power line voltage, i.e., the voltage difference between VLINE1 and VLINE2/NEUTRAL. In this sense, voltage converter 24 measures the magnitude of the line voltage and communicates the measurement to microcontroller 26. Voltage converter 24 converts the power line voltage into a scaled analog voltage signal having a magnitude that is appropriate for input into microcontroller 26.

Figure 3:
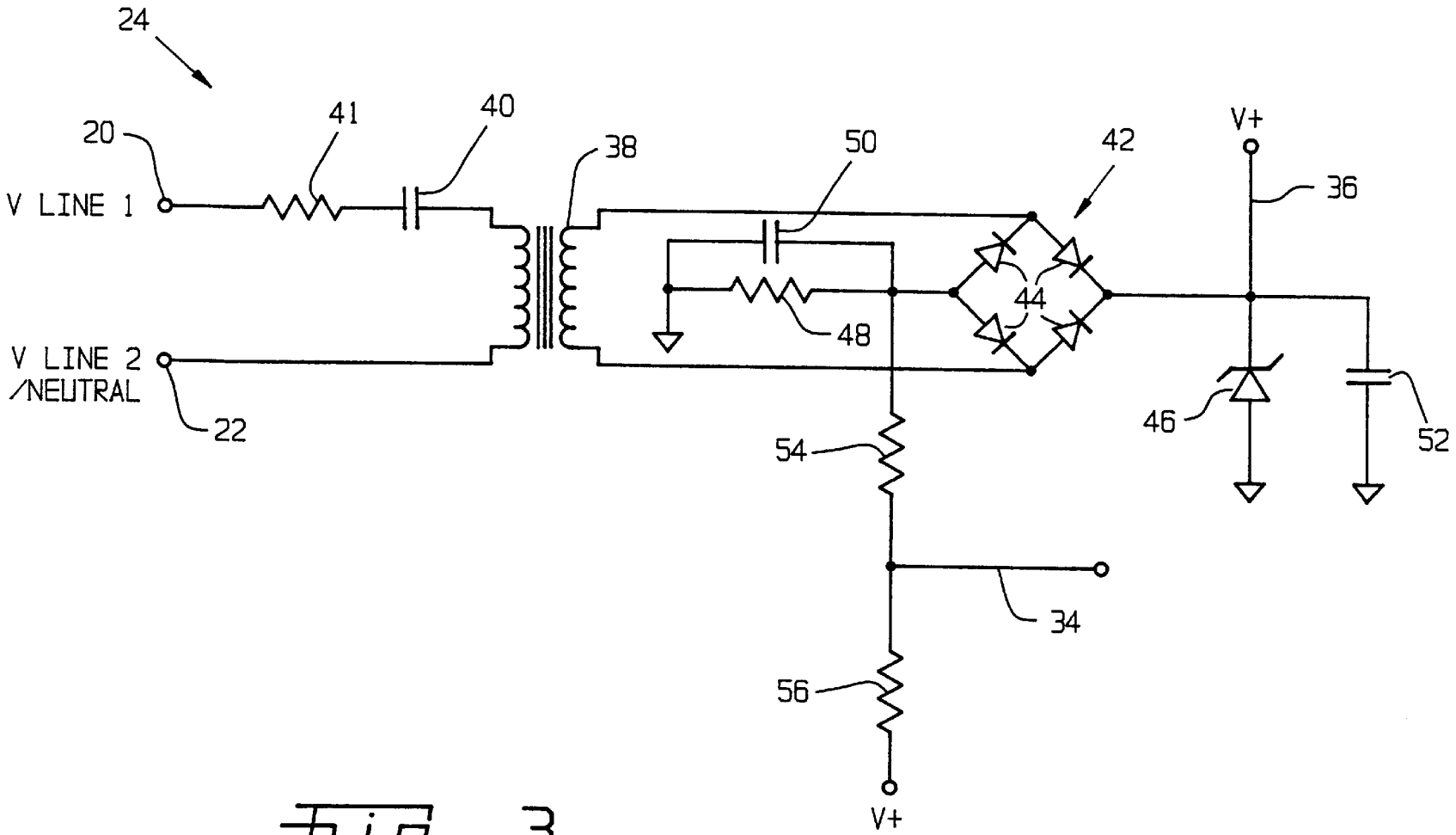
FIG. 3 is an electrical schematic diagram of one embodiment of the voltage converter of the heater control module of FIG. 2.

Voltage converter 24 is shown in more detail in the schematic diagram of FIG. 3. Besides the analog voltage signal transmitted on line 34 that is indicative of the supply voltage, voltage converter 24 also outputs a V+ signal on line 36 that is typically 5 volts. This V+ signal can be used to power microcontroller 26, sensor 28 and trigger device 30.

An optional 1:1 turns ratio power transformer 38 provides isolation from the power line for other components of voltage converter 24. The reactance of capacitor 40 reduces the line voltage to a value required for proper circuit operation. Using a reactance rather than a resistance has the advantage of dividing the line voltage without dissipating large amounts of power. The reactance of capacitor 40 is much greater than the equivalent resistance of the load of voltage converter 24. Thus, the circuit current is substantially a function of only the magnitude and frequency of the power line voltage and is substantially independent of the load resistance. This is critical for proper deicing system operation. At the instant of power application, resistor 41 limits circuit current to a safe value. Resistor 41 performs the current limiting function during a fast rate of rise or fall voltage transient.

A bridge rectifier 42 includes four diodes 44. Bridge 42 takes the absolute value secondary voltage of transformer 38. The load for bridge 42 includes a zener diode 46 and a resistor 48. A ground connection is made to the junction of resistor 48 and the anode of zener diode 46. Thus, the voltage drop across resistor 48 is negative with respect to ground and is a function of the magnitude and frequency of power line voltage. Filter capacitors 50 and 52 reduce voltage converter ripple currents to insignificant levels.

Resistors 54 and 56 and voltage V+ scale and shift the line voltage signal to a range of values appropriate for input to microcontroller 26 on line 34. This positive voltage decreases with increasing line voltage, i.e., the voltage on line 34 varies inversely with line voltage.

Microcontroller 26 includes an internal analog to digital converter to digitize the signal indicative of line voltage that is transmitted on line 34. Microcontroller 26 also includes a lookup table which associates the raw analog to digital output with one of the following possible approximate line voltage values: 100V, 120V, 200V or 230/240V. Thus, microcontroller 26 interprets the output of its A/D converter as indicating that the power line voltage is at one of these voltage levels. These values correspond to the majority of the power line voltages available throughout the world. The 230/240 voltage value compensates for the higher reactance of current limiting capacitor 40 at 50 Hz.

Microcontroller 26 includes an internal control device which controls switching device 32 through trigger device 30 dependent upon which magnitude of power line voltage has been identified. Microcontroller 26 controls switching device 32 in such a way that it is ensured that a same, optimum heating power level is dissipated by heating device 14 regardless of the magnitude of the line voltage. As is well known, the power dissipated by a resistive load is proportional to the square of the voltage applied across the load. Thus, to ensure that a same, optimum heating power level is dissipated by heating device 14, the time average of the square of the applied voltage must be constant. The present invention achieves this by cyclicly connecting and disconnecting the line voltage to/from heating device 14, with the time durations in which the line voltage is connected or disconnected varying with the measured magnitude of the line voltage.

For example, with a minimum line voltage of 100V, the line voltage can be applied to heating device 14 continuously. With a line voltage of 200V, however, the instantaneous power dissipated by heating device 14 will be four times as great (i.e., $200^2=4*100^2$). In order to ensure that the time average of the dissipated power is the same regardless of which of the two line voltages is present, the 200V line voltage can be applied to heating device 14 for only 25% of the total time that heater 14 is operating (i.e., $0.25*200^2=100^2$).

Figure 4:
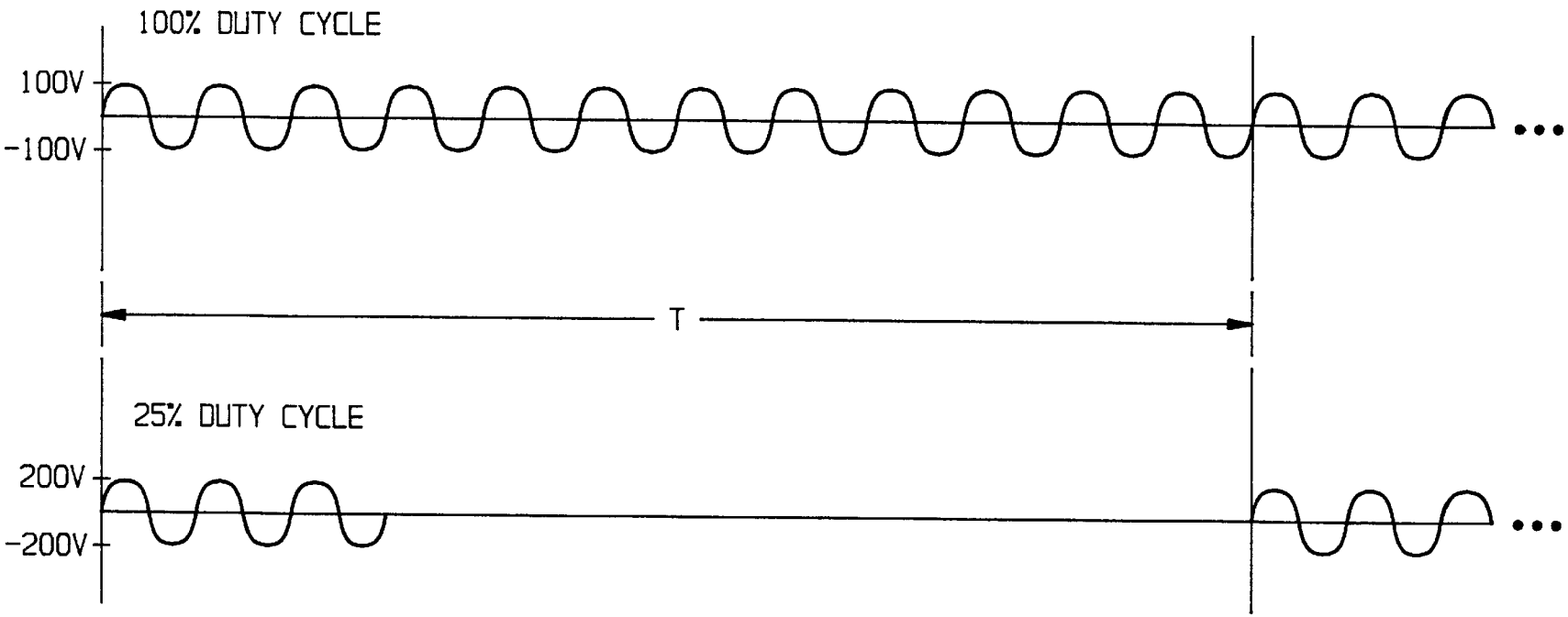
FIG. 4 is a plot of a power line voltage and a modulated power line voltage according to one embodiment of the present invention.

The total time in which the line voltage is applied to heating device 14, expressed as a fraction or percentage of the total time in which heating device 14 is operating or turned ON, is defined as the duty cycle of heating device 14. In the example discussed above, a duty cycle of 25% with a line voltage of 200V produces the same dissipated power in heater 14 as a duty cycle of 100% with a line voltage of 100V. These two duty cycles are shown in FIG. 4, with the cycling having a period of T.

The ON/OFF cycling of switching device 32 is performed at a fixed frequency that is substantially less than the line voltage frequency of 50 or 60 Hz. The time period T of the cycling can be approximately between 0.17 and 3.0 seconds, corresponding to cycling frequencies approximately between 0.3 and 6 Hz. The long thermal time constant of heaters 14 ensures that there is substantially no temperature change in heaters 14 during this cycle period.

The state of switching device 32 at any given moment determines whether the line voltage is applied to heater 14 at that moment. When switching device 32 is closed or turned ON, i.e., when it provides an internal conductive path therethrough, the line voltage is applied to heating device 14. Conversely, when switching device 32 is open or turned OFF, i.e., when it does not provide an internal conductive path therethrough, the line voltage is not applied to heating device 14. Switching device 32 is shown in FIG. 2 as being in the form of a bi-directional thyristor, also known as a triac.

A snubber network 58, including resistor 60 and capacitor 62, reduces the time rate of change of voltage transients appearing across triac 32 to a safe value. This ensures commutation while preventing unintentional triggering.

Trigger device 30 is in the form of a photo-isolated trigger integrated circuit. Trigger 30 protects microcontroller 26 from destructive voltage transients which may be present in the line voltage. An industry-standard Siemens IL-420 has been found to be acceptable as trigger device 30. It minimizes radio frequency interference by triggering triac 32 close to zero crossings of power line voltage VLINE1. A resistor 64 is used to set the current through a light emitting diode portion of trigger 30.

Heaters 14 are operated only when the ambient temperature is between two threshold temperatures. When the ambient temperature is below a lower one of the threshold temperatures, operation of heaters 14 would be ineffective. When the ambient temperature is above an upper one of the threshold temperatures, operation of heaters 14 is unnecessary. The threshold temperatures can be chosen, for example, as 0° F. and 38° F. Ambient temperature/moisture sensor and interface 28 ascertains the ambient temperature, produces an ambient temperature sensor signal corresponding thereto, and converts the signal into an analog signal which is appropriate for inputting to the microcontroller 26 via a conductive line 66.

The duty cycle of heaters 14 can also be modified based upon the ambient temperature in order to ensure that an optimally efficient level of heating power is dissipated by heaters 14. Clearly, less heating power is required to melt the ice on reflecting surface 18 at higher ambient temperatures than at lower ambient temperatures. Neglecting the effects of convection and radiation, the antenna temperature rise over ambient is substantially linearly proportional to heating power. For example, a heater producing a full power temperature rise of 32° F. will keep the antenna at or above freezing down to 0° F. Less power is needed to keep the antenna at or above freezing at higher ambient temperatures. By reducing the heating power at higher ambient temperatures, operating costs are reduced and a higher load current is permitted for a given triac heat sink size. Reducing the heat sink size permits a smaller enclosure, which in turn reduces manufacturing costs.

In one embodiment of the present invention, the duty cycle of heaters 14 has an inverse linearly proportional relationship with the ambient temperature between the two threshold temperatures. That is, a "temperature factor" may be determined which varies linearly between a value of 1.0 at 0° F. and 0.0 at 38° F. Whatever duty cycle that has been determined according to the magnitude of the line voltage would be reduced or multiplied by this temperature factor in order to arrive at a temperature compensated duty cycle. For example, a duty cycle corresponding to a line voltage of 200V would be determined to be 0.25, as discussed above. At an ambient temperature of 19° F., which is half way between the two threshold temperatures, the temperature factor would be determined to be 0.5. The "line voltage factor" of 0.25 is then multiplied by the temperature factor of 0.5 to arrive at a temperature compensated duty cycle of 0.125 or 12.5%. Microcontroller 26 then controls the switching of switching device 32 according to this temperature compensated duty cycle.

Another lookup table may be provided in microcontroller 26 to establish any desired linear or nonlinear relationship between the temperature factor and the ambient temperature.

It is also possible to operate heaters 14 only when snow and/or ice may be present, as determined by ambient temperature/moisture sensor 28. In this embodiment, heaters 14 are operable only when sensor 28 senses that the ambient temperature is below a threshold temperature, such as 38° F., and moisture is present.

Reflector heating device 14 is shown in the form of a heater wire attached to reflecting surface 18. However, it is to be understood that heating device 14 can also be in the form of electrodes. Further, heating device 14 can also be attached to a rear surface 68 of reflector 12 or embedded within reflecting surface 18. It is also possible for heating device 14 to be used to heat a feedhorn 70 of reflector 12.

The embodiment of the present invention shown herein is applied to the electrical heater of an antenna reflector. However, it is also possible to apply the present invention to other types of snow melting control applications in loading docks, sidewalks, access facilities for the physically handicapped, etc.

It is also possible to measure the frequency of the line voltage in addition to its magnitude. The scheme described herein has a power control uncertainty of ±6% depending upon whether the line frequency is 50 or 60 Hz. The duty cycle can then be adjusted based upon the measured line voltage frequency. This permits greater accuracy and allows a shorter duty cycle period.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of using a line voltage to heat an antenna reflector, said method comprising the steps of:

providing an electrical heater for said antenna reflector;

measuring a magnitude of the line voltage;

ascertaining an ambient temperature;

establishing a duty cycle for said heater dependent upon each of said measuring step and said ascertaining step, said duty cycle being defined as a percentage of total heating time in which the line voltage is electrically connected to said heater, said total heating time being a total time in which said ambient temperature is approximately between a first threshold temperature and a second threshold temperature; and cyclically connecting the line voltage to said heater and disconnecting the line voltage from said heater in accordance with said duty cycle.

2. The method of claim 1, wherein said cyclically connecting and disconnecting step has a fixed frequency.

3. The method of claim 2, wherein said fixed frequency is substantially less than a frequency of the line voltage.

4. The method of claim 1, wherein said step of establishing a duty cycle comprises the substeps of:

determining a first factor associated with said magnitude of the line voltage;

determining a second factor associated with said ambient temperature; and multiplying said first factor by said second factor to arrive at said duty cycle.

5. The method of claim 4, wherein said first factor varies inversely with a square of said magnitude of the line voltage.

6. The method of claim 4, wherein said second factor varies inversely with said ambient temperature.

7. The method of claim 1, comprising the further step of determining a presence of moisture, said establishing step being dependent upon said determining step.

8. A method of using a line voltage to heat an antenna reflector, said method comprising the steps of:

providing an electrical heater for said antenna reflector;

predetermining a desired average electrical power level to be dissipated by said heater;

turning said heater ON;

measuring a magnitude of the line voltage;

establishing a duty cycle for said heater to achieve said desired average electrical power level, said duty cycle being dependent upon said measuring step, said duty cycle being defined as a total time in which the line voltage is electrically connected to said heater divided by a total time in which said heater is ON; and cyclically connecting the line voltage to said heater and disconnecting the line voltage from said heater in accordance with said duty cycle.

9. The method of claim 8, wherein said cyclically connecting and disconnecting step has a fixed frequency.

10. The method of claim 8, wherein said duty cycle varies inversely with a square of said magnitude of the line voltage.

11. The method of claim 8, wherein said step of establishing a duty cycle includes the substep of providing a lookup table, said lookup table associating each of a plurality of line voltage magnitudes with a respective said duty cycle.

12. The method of claim 8, wherein said measuring step includes converting the line voltage into a scaled voltage signal having a magnitude appropriate for inputting into an electrical processor.

13. The method of claim 8, comprising the further steps of:

measuring a frequency of the line voltage; and adjusting said duty cycle dependent upon the frequency of the line voltage.

14. An antenna reflector assembly, comprising:

an antenna reflector;

an electrical heater configured for heating said antenna reflector;

a switching device electrically connected to said heater, said switching device being configured for selectively interconnecting said heater with a line voltage;

a voltage measuring device configured for measuring the line voltage; and a control device interconnecting said switching device and said voltage measuring device, said control device being configured for receiving said voltage measurements from said voltage measuring device and controlling said switching device dependent upon said voltage measurements.

15. The antenna reflector assembly of claim 14, wherein said control device is configured to control said switching device such that a predetermined level of electrical power is dissipated by said heater.

16. The antenna reflector assembly of claim 14, wherein said control device is configured for cyclicly closing and opening said switching device.

17. The antenna reflector assembly of claim 16, wherein a ratio of a time period in which said switching device is closed to a time period in which said switching device is open is dependent upon said voltage measurements.

18. The antenna reflector assembly of claim 14, further comprising:

an electrical processor including said control device; and a trigger device interconnecting said control device and said switching device.

19. The antenna reflector assembly of claim 18, wherein said trigger device defines a means for protecting said electrical processor from voltage transients in the line voltage.

20. The antenna reflector assembly of claim 18, wherein said voltage measuring device includes a voltage converter configured for converting said line voltage into a scaled voltage signal, said scaled voltage signal having a magnitude appropriate for inputting into said electrical processor.

* * * * *